US005501349A

United States Patent [19]

McCandless

[11] Patent Number: 5,501,349

[45] Date of Patent: Mar. 26, 1996

[54] TAMPER-INDICATING PLASTIC CLOSURE WITH SELECTIVELY STRENGTHENED PILFER BAND

[75] Inventor: Thomas J. McCandless, Crawfordsville, Ind.

[73] Assignee: H-C Industries, Inc., Crawfordsville, Ind.

[21] Appl. No.: 329,866

[22] Filed: Oct. 27, 1994

[51] Int. Cl.[6] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 4,322,009 | 3/1982 | Mumford . | |
| 4,418,828 | 12/1983 | Wilde et al. . | |
| 4,432,461 | 2/1984 | Mumford et al. | 215/252 |
| 4,635,808 | 1/1987 | Nolan | 215/252 |
| 4,741,447 | 5/1988 | John | 215/252 |
| 4,784,280 | 11/1988 | Breuer et al. | 215/252 |
| 4,938,370 | 7/1990 | McBride . | |
| 4,978,017 | 12/1990 | McBride . | |
| 5,040,692 | 8/1991 | Julian | 215/252 |
| 5,050,753 | 9/1991 | Trump et al. . | |
| 5,074,425 | 12/1991 | Wüstmann et al. | 215/252 |
| 5,090,788 | 2/1992 | Ingram . | |
| 5,107,998 | 4/1992 | Zumbuhl | 215/252 |
| 5,167,335 | 12/1992 | McBride et al. . | |
| 5,205,426 | 4/1993 | McBride et al. . | |
| 5,242,068 | 9/1993 | McCandless | 215/252 |
| 5,320,234 | 6/1994 | Kamath . | |
| 5,328,044 | 7/1994 | Röhrs et al. | 215/252 |

*Primary Examiner*—Allan N. Shoap
*Assistant Examiner*—Stephen Cronin
*Attorney, Agent, or Firm*—Dressler, Goldsmith, Shore & Milnamow, Ltd.

[57] ABSTRACT

A tamper-indicating plastic closure includes a top wall portion, a depending annular skirt portion, and a container-engaging pilfer band at least partially detachably connected to the skirt portion. In order to avoid premature fracture of the connection between the pilfer band and the closure skirt, a selectively strengthened frangible connection is provided, preferably comprising a series of first relatively weak bridges, and a series of second relatively strong bridges. The relatively strong bridges are provided about a major portion of the circumference of the pilfer band and are sufficiently strong to resist premature fracture. The minor portion of the circumference at which the first relatively weak bridges are provided fractures and separates first during closure removal, permitting the pilfer band to engage the container to create a high resistance to removal for thereafter sequentially fracturing the second bridges.

12 Claims, 2 Drawing Sheets

TAMPER-INDICATING PLASTIC CLOSURE WITH SELECTIVELY STRENGTHENED PILFER BAND

TECHNICAL FIELD

The present invention relates generally to tamper-indicating plastic closures for containers, and more particularly to a tamper-indicating closure having a selectively strengthened frangible connection between a skirt portion of the closure and the closure pilfer band to facilitate manufacture, handling, and application of closures while avoiding premature detachment of the pilfer band.

BACKGROUND OF THE INVENTION

Commonly assigned U.S. Pat. No. 4,418,828, Nos. 4,938,370, 4,978,017, 5,167,335, and 5,205,426, all hereby incorporated by reference, disclose various embodiments for pilfer bands of tamper-indicating plastic closures which have proven highly resistant to tampering or the like, and which are configured to facilitate economical, high speed manufacture. Each of these pilfer band constructions includes a plurality of inwardly extending flexible projections which move to an out-of-the-way disposition during application of the closure to an associated container, with the projections thereafter moving to an orientation for engaging an annular locking ring portion of the container during closure removal to at least partially detach the closure pilfer band from an associated skirt portion of the closure.

In order to provide the desired tamper-indicating function, such closures are manufactured with a frangible connection which at least partially detachably connects the closure pilfer band to the associated skirt portion. As will be appreciated, in order to provide the desired tamper-indicating function, a closure of this type must be manufactured so that the frangible connection between the pilfer band and the skirt portion does not fail or fracture during closure manufacture, handling, or high-speed application to an associated container. At the same time, the closure should consistently and reliably fracture attendant to partial or complete closure removal.

The present invention contemplates a tamper-indicating closure construction which desirably abates premature fracture of the connection between the closure pilfer band and the associated skirt portion.

SUMMARY OF THE INVENTION

In accordance with the present invention, a tamper-indicating plastic closure includes a frangible connection between a skirt portion of the closure and the container-engaging closure pilfer band positioned therebeneath. In order to avoid premature detachment of the pilfer band, the frangible connection between the pilfer band and the skirt portion is selectively strengthened along a major portion of the circumference of the pilfer band. This configuration has been found to desirably abate premature fracture, with the relatively weak, minor portion of the pilfer band configured to initially fracture during closure removal.

In accordance with the illustrated embodiment, the present tamper-indicating closure includes a generally cup-shaped plastic closure cap having a circular top wall portion, and a depending annular skirt portion. The skirt portion includes a helical, internal thread formation, which cooperates with a like thread formation on the associated container for removably retaining the closure in position thereon.

The present closure further includes a tamper-indicating pilfer band positioned beneath the skirt portion of the closure, with the pilfer band including an arrangement for engaging the container for tamper-indication. In the illustrated embodiment, this arrangement comprises a plurality of inwardly extending tab-like projections which are configured to engage an annular, locking ring portion of the container.

In accordance with the present invention, a selectively strengthened frangible connection is provided for at least partially detachably connecting the pilfer band to the skirt portion of the closure. The frangible connection comprises a series of first frangible bridges which detachably connect a minor portion of the circumference of the pilfer band to the skirt portion, and a series of second frangible bridges which at least partially detachably connect a major portion of the circumference of the pilfer band to the skirt portion. The second bridges exhibit higher resistance to fracture than the first bridges, so that during removal from the container, the first bridges fracture for tamper-indication prior to fracture of the second bridges.

The second bridges, which extend along a major portion of the circumferential extent of the pilfer band, are configured to resist undesired premature fracture of the pilfer band. During closure removal, the relatively weak first bridges initially fracture, with a portion of the pilfer band, at which the first bridges are provided, tending to slip beneath the associated container locking ring as the closure is unthreaded from the container. This results in very positive engagement and interference of the pilfer band with the container locking ring, thus creating a high degree of resistance to closure removal. This resistance is sufficiently high to break the relatively strong second bridges in a "zipper-like" sequential manner. Specifically, the second bridges fracture sequentially, after fracture of the first bridges, starting with at least one of the second bridges positioned circumferentially adjacent to one of the first bridges.

In the preferred embodiment, the first and second bridges are provided so that they extend between the inside surfaces of the skirt portion and the pilfer band, but it is within the purview of the present invention that the bridges can be otherwise configured, such as by the provision of a series of bridges extending generally with the vertical confines of the pilfer band and the skirt portion Other features and advantages of the present invention will become readily apparent from the following detailed description, the accompanying drawings, and the appended claims.

DETAILED DESCRIPTION

Figure 1:
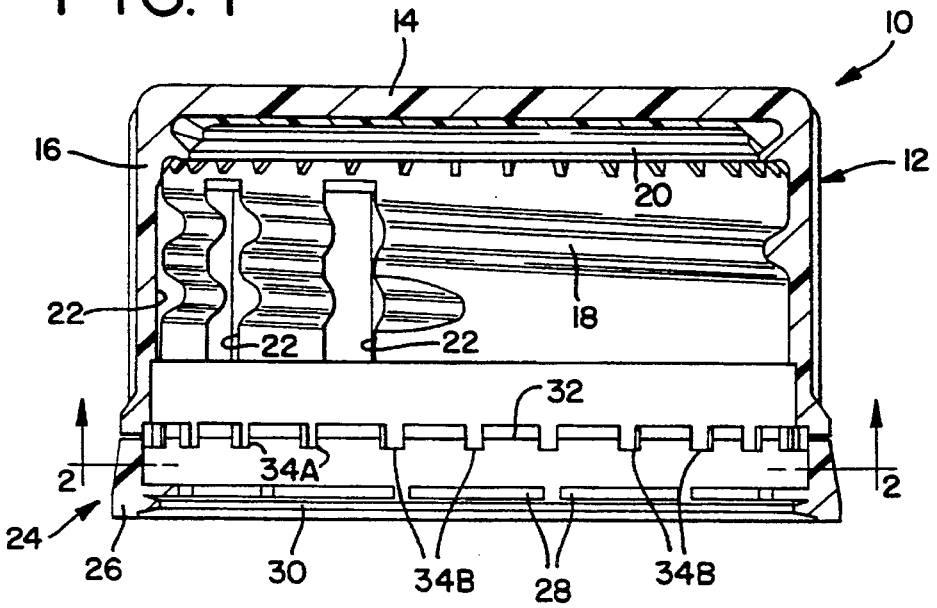
FIG. 1 is a cross-sectional view of a tamper-indicating plastic closure embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference to the drawings, therein is illustrated a tamper-indicating plastic closure 10 embodying the principles of the present invention. The closure 10 includes a generally cup-shaped closure cap 12 having a circular top wall portion 14, and a depending annular skirt portion 16. The skirt portion 16 includes an internal thread formation 18 configured for cooperation with a like thread formation on an associated container C to which the closure is fitted.

Closure 10 can be provided with a sealing liner 20 positioned adjacent the top wall portion of the closure for effecting sealing engagement with an associated container. When the closure is used on a container having a carbonated beverage or the like, it is desirable to release the gas pressure within the container prior to disengagement of the thread formation 18 from the container thread. The provision of axially extending vent grooves 22, which traverse the thread formation 18 and preferably extend into the side wall of the closure, provide flow paths for the release of this gas pressure upon disengagement of the sealing liner 20 from the container finish.

To provide visually discernable evidence that the closure 10 has been partially or completely removed from the associated container, the closure includes a selectively strengthened pilfer band 24 which is at least partially detachably connected to the skirt portion 16 of the closure. In the illustrated embodiment, pilfer band 24 comprises an annular band portion 26, inwardly from which extends a plurality of relatively flexible tab-like projections 28, each movable about a respective horizontal axis. In the illustrated embodiment, the pilfer band 24 includes an annular interference bead 30 positioned beneath the projections 28, with the projections 28 and the interference bead 30 cooperating to desirably provide two modes of interfering action with the associate container for tamper-indication, in accordance with the teachings of U.S. Pat. No. 4,938,370. Specifically, when the projections 28 extend generally angularly and upwardly with respect to the band portion 26 of the pilfer band, the free ends of the projections generally engage and abut the annular container locking ring L of the associated container C. This orientation of the projections provides the first mode of tamper-indication, acting to at least partially detachably connect and separate pilfer band 24 from the closure skirt portion 16 during closure removal. Additionally, the projections are positionable to extend generally angularly downwardly, so that the projections engage and coact with the interference bead 30 to effectively decrease the inside diameter of the pilfer band. This again provides the desired interfering engagement with the container locking ring, thus providing the second mode of tamper-indication.

While the pilfer band has been illustrated in a form in accordance with U.S. Pat. No. 4,938,370, it will be understood that the pilfer band can-be otherwise configured, such as in accordance with U.S. Pat. No. 4,418,828, or U.S. Pat. No. 5,090,788, issued Feb. 25, 1992, hereby incorporated by reference.

Pilfer band 24 is at least partially detachably connected with the skirt portion 16 by a frangible connection which joins the pilfer band to the skirt portion. In a presently preferred embodiment, this frangible connection is provided by a score line 32 which extends circumferentially of the closure, and which at least partially separates and distinguishes the pilfer band from the skirt portion. The frangible connection itself preferably comprises a plurality of circumferentially spaced frangible bridges, which, as will be described further hereinafter, are provided in the form of a series of first relatively weak frangible bridges 34A, and a series of relatively strong second frangible bridges 34B.

It is presently contemplated that the series of first frangible bridges 34A detachably connect a minor portion of the circumference of pilfer band 24 to the skirt portion 16, while the second frangible bridges 34B at least partially detachably connect a major portion of the circumference of the pilfer band to the skirt portion. Because the second bridges 34B exhibit higher resistance to fracture than the first bridges 34A, during closure removal from the associated container, the first bridges fracture for tamper-indication prior to fracture of the second bridges.

In a presently preferred embodiment, this difference in fracture strength is provided by configuring first bridges 34A to be dimensionally smaller than second bridges 34B, with the differing widths but the same radial dimension, and scoring the bridges at score line 32 to a substantially uniform radial depth; alternatively, the first and second bridges can be scored to differing radial depths so that they exhibit the desired differing resistance to fracture. Each of the fracturable first and second bridges define a fracturable residual portion, with the cross-sectional area of the residual portion of each of the first bridges being less than the cross-sectional area of the fracturable residual portion of each of the second bridges.

While it is presently preferred that each of the first and second bridges be provided to extend between the inside surfaces of the skirt portion 16 and the pilfer band 24, it is within the purview of the present invention to otherwise configure the bridges, such as disposing the bridges generally within the vertical confines of the skirt portion and pilfer band, either by molding, or serrated scoring such as shown in U.S. Pat. No. 4,322,009, Mar. 30, 1982, hereby incorporated by reference. Bridges formed other than by molding on the inside surfaces of the pilfer band can be partially scored after formation to provide the desired fracturable residual portion.

In a current embodiment, each of the first bridges 34A has a radial dimension of about 0.019 inches, and a width of about 0.0155 inches. Each of the second bridges 34B has a radial dimension of 0.019 inches, and a width of about 0.030 inches. It is presently preferred that all of the first and second bridges be scored, by the score line 32, to a substantially uniform depth, so that the unscored residual portion of each bridge has a radial extent of about 0.012 inches to about 0.016 inches. Thus, the unscored, fracturable residual portion of each first bridge has a cross-sectional area which is less than the cross-sectional area of the unscored fracturable residual portion of each of the second bridges. In this current embodiment, the fracturable residual portion of each second bridge 34B has a cross-sectional area which is about two times that of each first bridge 34A.

Figure 2:
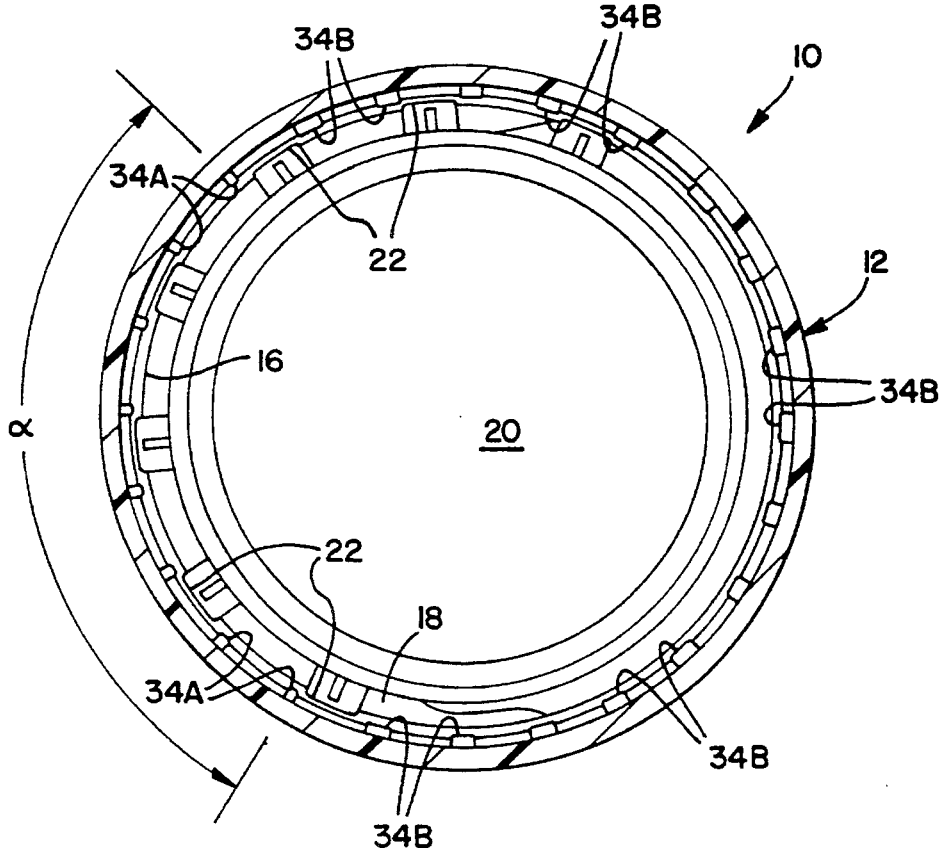
FIG. 2 is a view taken along lines 2—2 of FIG. 1.

In accordance with the present invention, the relatively strong frangible connection between the pilfer band 24 and the skirt portion 16 is provided along a major portion of the circumferential extent of the pilfer band of the closure, while the relatively weak portion provided by first bridges 34A, is provided along a minor extent. In a presently preferred embodiment, this minor extent is between about 90° and 180° of the circumference of the pilfer band, with a current embodiment, as illustrated in FIG. 2, having first bridges 34A detachably connecting about 120° of the circumference of the pilfer band 24 to the skirt portion. While the number, circumferential spacing, and dimensions of the first and second bridges 34A and 34B can be selectively varied, the illustrated embodiment includes eight (8) of the first circumferentially spaces first bridges 34A, and 16 of the second circumferentially spaced bridges 34B. Thus, there are about two times as many second bridges as first bridges.

Figure 3:
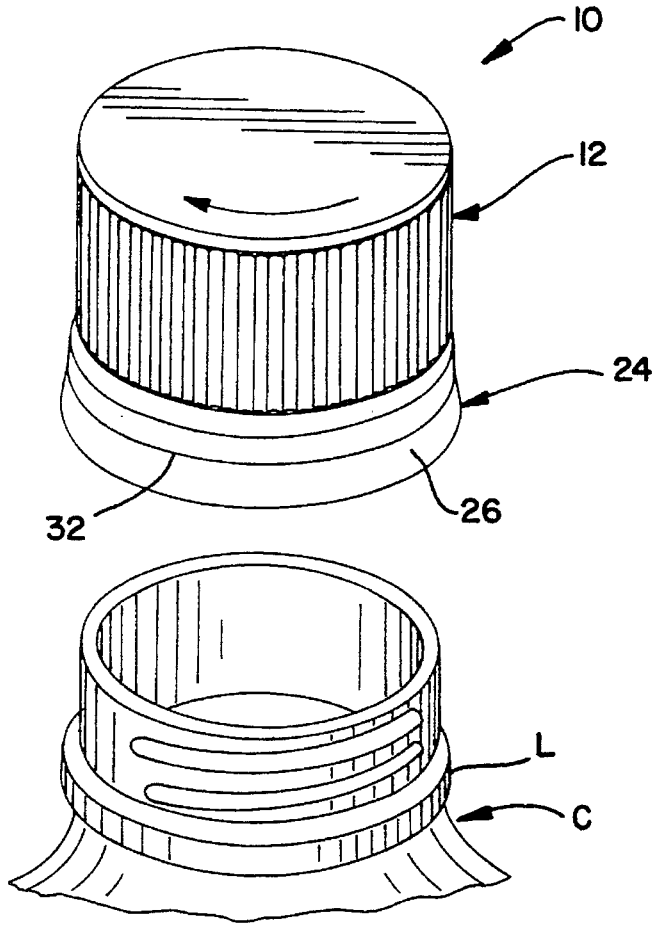
FIGS. 3 and 4 are perspective views respectively illustrating application of the present closure to an associated container, and removal of the closure therefrom.
Figure 4:
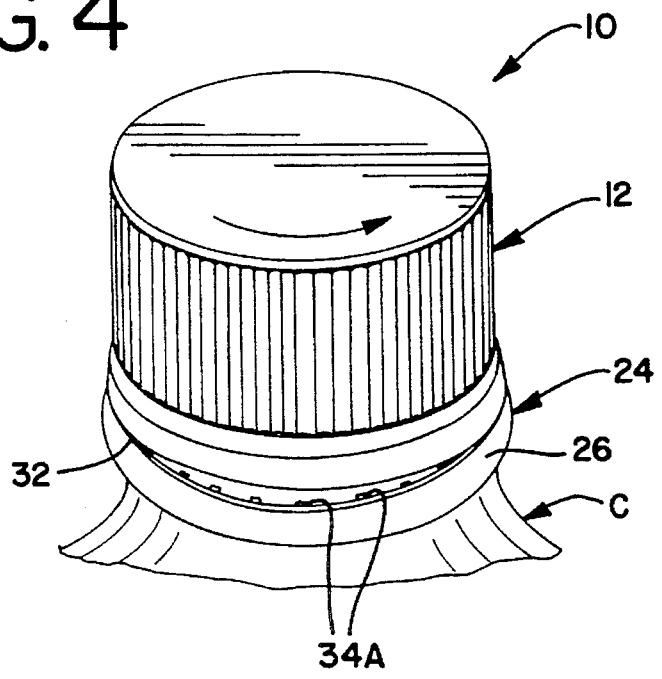

FIG. 3 generally illustrates application of the closure 10 to the associated container C, with FIG. 4 illustrating the closure after removal from the container has been initiated. As shown in FIG. 4, the relatively weak first bridges 34A initially break and fracture, prior to fracture of bridges 34B. Attendant to this action, the pilfer band 24 tends to slip beneath the container locking ring L thus creating a high degree of resistance in the pilfer band to closure removal. This high degree of resistance does not necessarily depend upon the rigidity or resilience of the flexible projections 28, but takes advantage of the inherent hoop strength of the pilfer band to engage the container and resist closure removal. This relatively high resistance to closure removal acts to sequentially fracture the relatively strong second bridges 34B in a progressive "zipper-like" fashion, starting with at least one of the two bridges 34B which are respectively adjacent to bridges 34A. This progressive and sequential fracture of the bridges 34B continues until all of the frangible bridges 34B are fractured, whereupon the closure skirt is free of the pilfer band and can be removed from the container.

Thus, the second bridges 34B, which are provided about a major portion of the circumference of the closure, can be configured to resist premature fracture (such as by side loading of the pilfer band), even if the bridges 34B exhibit a higher resistance to fracture than would otherwise be desirable if their fracture depended solely upon interference of projections 28 with the container locking ring L. This is possible by configuring first bridges 34A to fracture as a result of projections 28 engaging the locking ring, with the subsequent relatively high resistance to removal which occurs as the partially separated pilfer band slips beneath the locking ring providing the necessary resistance to sequentially fracture the relatively strong second bridges 34B. Since the relatively weak first bridges extend about only a minor portion of the closure, the overall resistance of the frangible connection to premature fracture is very desirably enhanced.

While not illustrated, it is within the purview of the present invention to provide the pilfer band 24 with one or more fracturable regions so that the band splits into one or more segments, which fracturable regions may be configured in accordance with U.S. Pat. No. 5,320,234, hereby incorporated by reference, with the pilfer band 24 further optionally including one or more connector portions so that the fractured pilfer band is partially, but not completely detached from the skirt portion.

From the foregoing, it will be observed that numerous modifications and variations can be effected without departing from the true spirit and scope of the novel concept of the present invention. It is not intended that the present invention be limited to the specific embodiments illustrated herein. The disclosure is intended to cover, by the appended claims, all such modifications as fall within the scope of the claims.

What is claimed is:

1. A tamper-indicating closure for a container, comprising:

a plastic closure cap having a top wall portion, and a depending annular skirt portion;

a tamper-indicating pilfer band positioned beneath said skirt portion, said pilfer band including means for engaging said container for tamper-indication; and selectively strengthened frangible means at least partially detachably connecting said pilfer band to said skirt portion, said frangible means comprising first frangible bridge means detachably connecting a minor portion of the circumference of said pilfer band to said skirt portion, and second frangible bridge means at least partially detachably connecting a major portion of the circumference of said pilfer band to said skirt portion, said second bridge means exhibiting higher resistance to fracture than said first bridge means so that during removal from the container, said first bridge means fracture for tamper-indication prior to fracture of said second bridge means, said first bridge means comprises a series of circumferentially spaced apart first frangible bridges respectively having substantially uniform first fracturable cross-sectional areas, and said second frangible means comprises a series of circumferentially spaced apart second frangible bridges respectively having substantially uniform second fracturable cross-sectional areas, said second cross-sectional area being greater than said first cross-sectional area so that after fracture of said first bridges, said second frangible bridges fracture sequentially, starting with at least one of said second bridges positioned circumferentially adjacent to one of said first bridges, said first bridge means detachably connecting between 90° and 180° of the circumference of said pilfer band to said skirt portion.

2. A tamper-indicating closure in accordance with claim 1, wherein said first and second frangible bridges extend between inside surfaces of said skirt portion and said pilfer band.

3. A tamper-indicating closure in accordance with claim 1, wherein:

each of said frangible first and second bridges are scored to define said fracturable first and second cross-sectional areas.

4. A tamper-indicating closure in accordance with claim 1, wherein:

said means for engaging said container comprises a plurality of inwardly extending flexible projections.

5. A tamper-indicating closure in accordance with claim 1, wherein:

said first bridge means detachably connect about 120° of the circumference of said pilfer band to said skirt portion.

6. A tamper-indicating closure for a container, comprising:

a plastic closure cap having a top wall portion, and a depending annular skirt portion;

a tamper-indicating pilfer band positioned beneath said skirt portion, said pilfer band including means for engaging said container for tamper-indication; and selectively strengthened frangible means at least partially detachably connecting said pilfer band to said skirt portion, said frangible means comprising a series of circumferentially spaced apart first frangible bridges detachably connecting a minor portion of the circumference of said pilfer band to said skirt portion, and a series of circumferentially spaced apart second frangible bridges connecting a major portion of the circumference of said pilfer band to said skirt portion, said first frangible bridges detachably connecting between 90° and 180° of the circumference of said pilfer band to said skirt portion, said closure including a score extending partially into said first and second frangible bridges, whereby each of said frangible bridges defines a fracturable residual portion, the cross-sectional area of the residual portion of each of said first bridges being less than the cross-sectional area of the fracturable residual portion of each of said second bridges, so that during removal of said closure from said container, said first frangible bridges fracture prior to fracture of said second frangible bridges, said second frangible bridges fracturing sequentially starting with at least one of said second bridges positioned circumferentially adjacent to one of said first bridges, said first and second bridges having differing widths and the same radial dimension, with said score extending to a substantially uniform depth into said bridges.

7. A tamper-indicating closure in accordance with claim 6, wherein:

said first frangible bridges detachably connect about 120° of the circumference of said pilfer band to said skirt portion.

8. A tamper-indicating closure in accordance with claim 6, including:

a sealing liner positioned adjacent said top wall portion of said plastic closure cap.

9. A tamper-indicating closure in accordance with claim 6, wherein:

said means for engaging said container comprises a plurality of inwardly extending flexible projections.

10. A tamper-indicating closure in accordance with claim 6, wherein:

the cross-sectional area of the fracturable residual portion of each said second bridges is about two times the cross-sectional area of the fracturable residual portion of each said first bridge.

11. A tamper-indicating closure in accordance with claim 6, wherein:

said frangible connection includes about two times as many of said second bridges as said first bridges.

12. A tamper-indicating closure in accordance with claim 6, wherein:

said first and second bridges extend between inside surfaces of said skirt portion and said pilfer band, and said score extends circumferentially of said closure and into said bridges.

* * * * *